US007461419B2

(12) United States Patent
Milne

(10) Patent No.: US 7,461,419 B2
(45) Date of Patent: Dec. 9, 2008

(54) LIQUID DELIVERY SYSTEM FOR A SINK

(76) Inventor: Victoria Milne, 73 Cayler St., Top Studio, Brooklyn, NY (US) 11222

( * ) Notice: Subject to any disclaimer, the term of this patent is extended or adjusted under 35 U.S.C. 154(b) by 168 days.

(21) Appl. No.: 11/644,146

(22) Filed: Dec. 22, 2006

(65) Prior Publication Data

US 2007/0124857 A1 Jun. 7, 2007

Related U.S. Application Data

(63) Continuation-in-part of application No. 10/820,192, filed on Apr. 7, 2004, now Pat. No. 7,155,759.

(60) Provisional application No. 60/460,865, filed on Apr. 7, 2003.

(51) Int. Cl.
*E03C 1/04* (2006.01)

(52) U.S. Cl. ..... 4/675; 4/619; 4/624; 134/186

(58) Field of Classification Search ..... 4/619, 4/651, 653, 675, 300.3; 134/186, 199
See application file for complete search history.

(56) References Cited

U.S. PATENT DOCUMENTS

| | | | | |
|---|---|---|---|---|
| 624,176 A | | 5/1899 | Chisholm | |
| 1,178,817 A | * | 4/1916 | Murton | 134/199 |
| 1,295,470 A | * | 2/1919 | Fisher | 134/186 |
| 1,382,992 A | * | 6/1921 | Lombard | 68/184 |
| 1,426,046 A | | 8/1922 | Cohen | |
| 1,461,797 A | * | 7/1923 | Heide | 174/152 S |
| 1,681,322 A | * | 8/1928 | Cave | 134/111 |
| 1,805,560 A | | 5/1931 | Barta | |
| 4,231,123 A | | 11/1980 | Cheng | |
| 5,069,235 A | * | 12/1991 | Vetter et al. | 134/113 |
| 7,155,759 B2 | * | 1/2007 | Milne | 4/675 |

* cited by examiner

*Primary Examiner*—Charles E Phillips
(74) *Attorney, Agent, or Firm*—Gottlieb, Rackman & Reisman PC

(57) ABSTRACT

A liquid delivery system for a sink comprises a basin having a multiplicity of perforations located therein in an irregular pattern, a faucet assembly in fluid communication with a source of the liquid and with a first plurality of the perforations, and a drain assembly in fluid communication with a second plurality of the perforations and with a third plurality of the perforations, the drain assembly allowing egress of the liquid from the basin through the third plurality of the perforations and being selectively operable to allow egress of the liquid from the basin through the second plurality of the perforations. Upon selective activation of the faucet assembly, the liquid is introduced into the interior of the basin from all sides in a plurality of independent streams that converge toward and intersect with one another in the air above the basin to form a pleasing, dome-shaped display.

26 Claims, 4 Drawing Sheets

LIQUID DELIVERY SYSTEM FOR A SINK

REFERENCE TO RELATED APPLICATIONS

This application is a continuation-in-part of prior U.S. patent application Ser. No. 10/820,192, filed Apr. 7, 2004 now U.S. Pat. No. 7,155,759, which claims the benefit of prior U.S. Provisional Patent Application Ser. No. 60/460,865, filed Apr. 7, 2003.

TECHNICAL FIELD

The present invention relates broadly to the field of plumbing fixtures, and in particular, to a novel liquid delivery system for a sink that is adapted primarily for use in a residential household setting or in a commercial hospitality setting. More specifically, this invention relates to a sink that provides a novel configuration for the delivery of water or other liquids which results in a pleasing, fountain-like display when the faucet mechanism is actuated.

BACKGROUND OF THE INVENTION

Since the advent of indoor plumbing for dwelling structures such as homes and hotels, efforts have been made to create plumbing fixtures such as sinks for bathrooms, lavatories and other environments which are practical yet esthetically pleasing, not only in their appearance but also in their operation. Traditionally, such sinks have been molded from cast iron or have been manufactured from stamped sheet metal in a substantially hemispherical shape, and a durable surface coating, such as porcelain enamel, has usually been applied to the exposed inside surface of the sink bowl, and sometimes also to its outside surface, although nowadays such sinks may be formed of other substrate materials (e.g., plumbing brass), and may be coated with other coating materials (e.g., polished nickel), as well.

However, despite many years of the design, as well as the manufacture and production, of countless manifestations of sinks and lavatory washbasins and their associated faucet mechanisms, the manner in which the water is introduced and delivered into the sink bowl upon actuation of the faucet mechanism has not changed significantly. Typically, the water is drawn (or pumped) through one or more pipe conduits from a remote water source (such as a private well or a public utility's water supply reservoir) into a faucet assembly, and is conventionally then discharged from the faucet assembly into the sink bowl, either in two separate downward streams from two independent spouts (one for hot water and the other for cold), or in more recent manifestations, in a unitary downward stream from a single spout (with the hot and cold water having been pre-mixed within the faucet assembly); the rate of the water flow is typically controlled by two user-operated flow control mechanisms (one for the hot water and one for the cold), or again in more recent manifestations, by a single user-operated flow control mechanism associated with and located within the faucet assembly, which simultaneously functions to allow the user to adjust the proportions of hot and cold water so as to achieve a mixture having the desired water temperature.

Although the practical advantages of these prior art liquid delivery systems cannot be overlooked, they nevertheless lack creativity and imagination in the way in which the water is dispensed and is introduced into the sink bowl. In view of these deficiencies of the prior art, it is the principal object of this invention to provide a novel liquid delivery system for sinks, lavatory washbasins and the like that achieves the same practical results as the prior art systems, yet provides for the water to be delivered in a more esthetically pleasing manner which at the same time may also provide other wash-experience benefits.

SUMMARY OF THE INVENTION

The invention provides a liquid delivery system for sinks, lavatory washbasins and the like wherein the water is not delivered in a conventional downward stream from the tap, i.e., from one or two relatively large spouts, but is instead delivered through a plurality of small perforations that are provided in the wall of the sink bowl. In accordance with the preferred embodiment, the perforations are situated throughout the sink bowl and although they are of substantially uniform appearance, they actually provide three different functions and are therefore divided horizontally, by function, into three ring-shaped zones or groupings of perforations, the uppermost group providing for fresh water ingress, and the other two, lower groups providing for waste water egress, as will hereinafter be described; most preferably, the perforations vary in size, and are spaced apart from one another in an irregular, random fashion. Upon actuation of the faucet mechanism, the water enters the sink bowl in a plurality of narrow streams from all sides through the perforations in the uppermost group, providing a novel and esthetically pleasing three-dimensional display of water upon its delivery into the bowl. In addition, the introduction of water from all sides in this manner provides a water delivery mode that may also improve the quality of the cleansing resulting from its use. Upon actuation of the drain stopper, waste water will be retained in the lower-region of the sink basin, with the intermediate group of perforations providing for overflow drainage as additional fresh water continues to enter the sink basin through the perforations in the uppermost group, thereby preventing the waste water from accumulating and reaching the level of the perforations in the uppermost group, and thus avoiding contamination of the fresh water entering the sink basin.

BRIEF DESCRIPTION OF THE DRAWINGS

These and other aspects, features, objects and advantages of the present invention will become more apparent from the following detailed description of the presently most preferred embodiment thereof (which is given for the purposes of disclosure), when read in conjunction with the accompanying drawings (which form a part of the specification, but which are not to be considered limiting in its scope), wherein.

DETAILED DESCRIPTION OF THE PREFERRED EMBODIMENT

Figure 1:
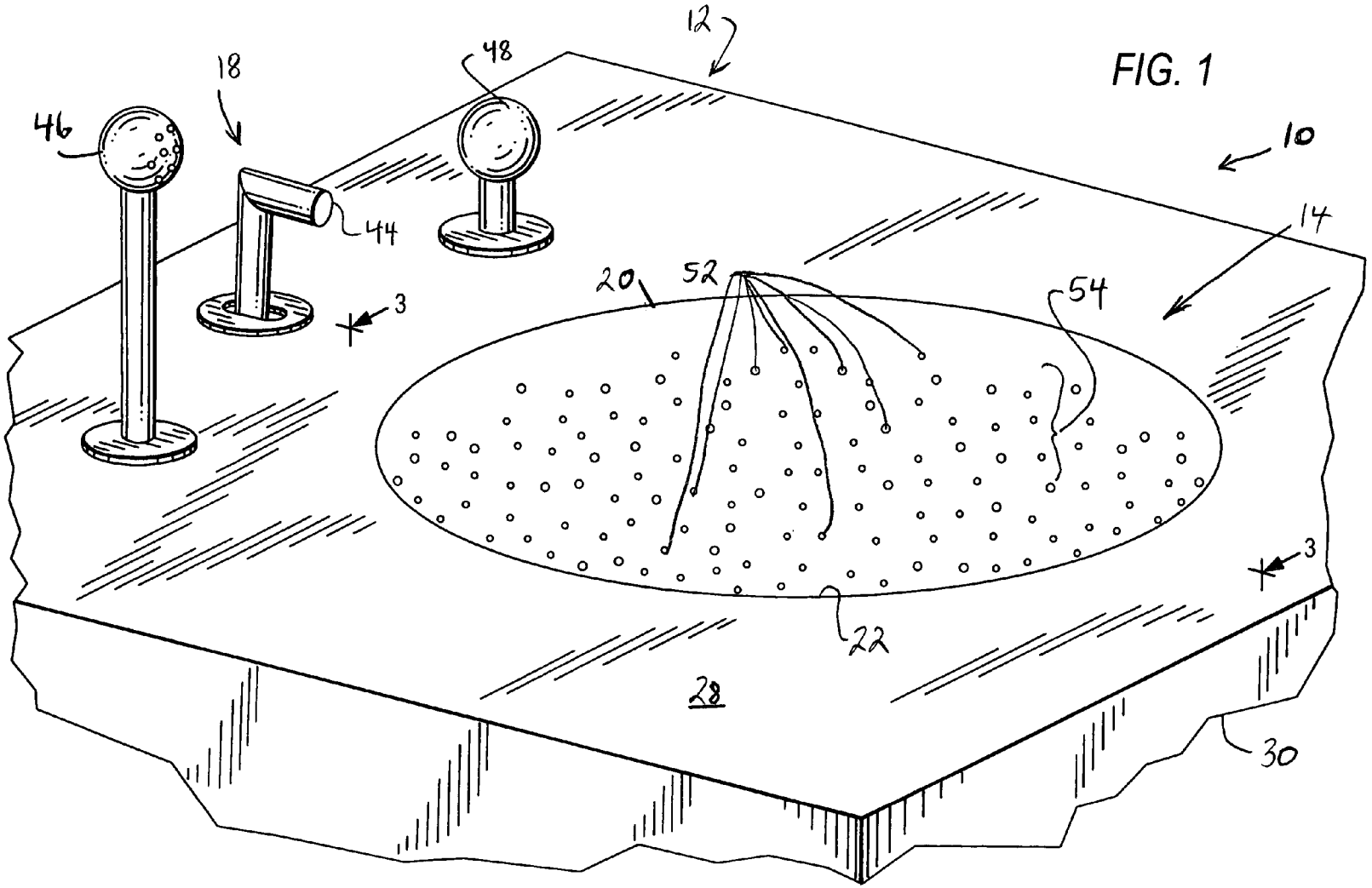
FIG. 1 is a perspective view of the preferred embodiment of the liquid delivery system of the present invention, illustrating its structure and appearance in the absence of the flow of water.

The preferred embodiment of the present invention will now be further described with reference to the accompanying drawings, wherein like reference numerals designate like or corresponding parts throughout the several views. Although the invention will be illustratively described hereinafter with reference to a lavatory washbasin, it should be understood that the invention is not limited to the environment of a bathroom or lavatory, but could be used in other similar plumbing environments, e.g., in a kitchen sink or work sink. Moreover, although the liquid to be delivered will commonly be conventional lavatory water, it is to be understood that other liquids may be used in place of water, and accordingly, all references hereinafter to water shall be understood as referring not only to lavatory water itself, but to any other appropriate liquid as well.

Referring to the drawings, a liquid delivery system for a lavatory washbasin in accordance with the preferred embodiment of the present invention is generally designated 10. Liquid delivery system 10 includes a conventional sink assembly 12, which principally comprises a sink bowl 14, a drain assembly 16, and a faucet assembly 18. Sink bowl 14 comprises a concave cavity or basin 20, having an inner basin surface 22 and an outer basin surface 24. Basin 20 may be formed from a material that is at least one-quarter inch thick and at most one-half inch thick, preferably a solid surfacing polymer material such as the methacrylate resin marketed by E. I. du Pont de Nemours and Company, of Wilmington, Del., U.S.A. under the trademark CORIAN, although as is well known in the art, alternative materials include any material that is waterproof or that can be made waterproof, and that can be perforated, such as other polymers, glass, cast metals, ceramics, resins, rubbers or even traditional vitreous porcelain enamel. The use of such materials enables basin 20 to be manufactured integrally with a counter-top 28 of a typical decorative vanity 30 (the latter shown only in cutaway in FIGS. 1 and 2), but the present invention is not dependent on such an installation, and it is to be understood that the invention may be used in other environments, e.g., if the sink were installed above the counter-top, or even in a free-standing environment.

Typically, basin 20 may be formed either by heat-forming the polymeric material from a sheet, or by casting or milling it from a block. Commonly, basin 20 is hemispherically curved, most commonly on a radius of 8.5 inches. However, basin 20 may alternatively be formed using other radii of curvature or even in other concave shapes, e.g., as a fluted, cylindrical, or pyramid-shaped cavity, or even as a non-geometric, randomly-shaped cavity.

Drain assembly 16 comprises a liquid drainage chamber 31 which is situated directly underneath basin 20 and which is in fluid communication with the interior of basin 20 (in a manner to be described in further detail hereinafter) and with a principal drain aperture 32 (not shown in FIGS. 1 and 2 and not visible to the user of the sink), the latter also being in fluid communication with a waste conduit 36. Drain assembly 16 further comprises a stopper 38 for mechanically blocking principal drain aperture 32 in order to selectively retain waste water in basin 20. Stopper 38 reciprocates between a closed position (shown in FIG. 3), in which waste water will be retained, and an open position (shown in FIG. 4) in which waste water may flow freely into waste conduit 36. Drain assembly 16 also comprises an annular overflow duct 40 which is in fluid communication with waste conduit 36 and also with the interior of basin 20 (in a manner to be described in further detail hereinafter).

Faucet assembly 18 may be of the hot/cold mixing type, and would include the usual manifold structure (not shown), having conventional on-off valves (not shown) mounted in its opposite ends, with those valves being connectable by means of threaded tubular pipes (not shown) to conduits (not shown) connected to separate sources of hot and cold water. Water admitted to the manifold structure by the on-off valves is conducted to a centrally located mixing chamber portion of the manifold, and in the preferred embodiment of the present invention, when the water exits the mixing chamber it is conducted into a water distribution conduit, which will be described in further detail hereinafter. As is customary in mixing faucets of this type, the manifold structure is concealed within decorative vanity 30, and is connected through one or more suitable apertures therein to a conventional water flow control 44 which is also preferably coupled to the on-off valves in a typical manner, allowing selective activation thereof and consequent mixing of hot and cold water so as to achieve the desired water temperature. Although as shown illustratively in the drawings, water flow and hot/cold mixing control 44 may be located adjacent to sink bowl 14, it is to be understood that in accordance with the invention all of faucet assembly 18, including water flow and hot/cold mixing control 44, may alternatively be placed in a location that is more remote from sink bowl 14. It should also be understood that faucet assembly 18 need not even be of the mixing type, especially if liquid delivery system 10 will not be used in a traditional lavatory setting, in which case faucet assembly 18, including water flow control 44, may even be placed in a location that is remote from sink assembly 12, e.g., in a separate room or even in a separate building.

Figure 2:
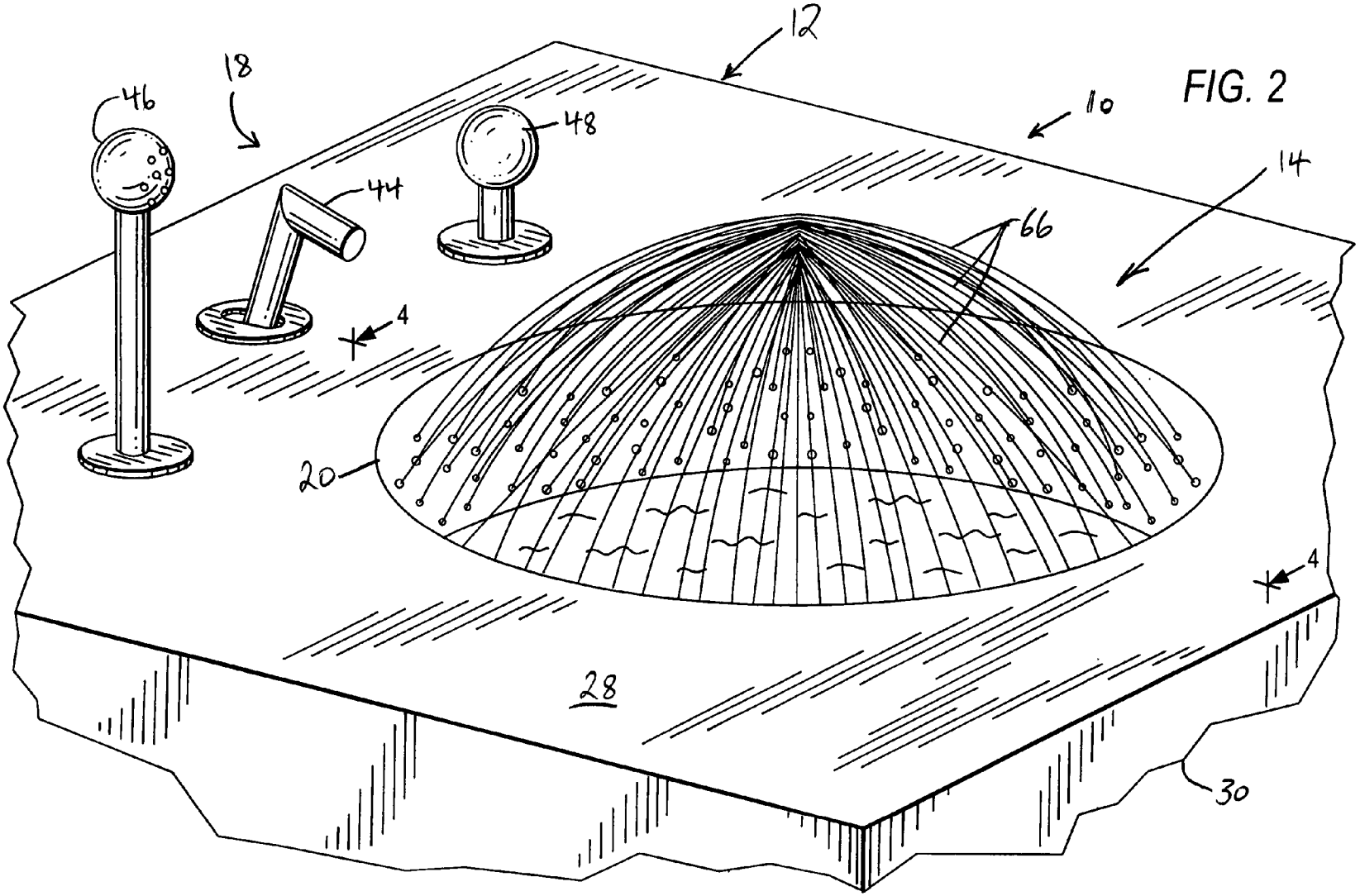
FIG. 2 is a perspective view similar to that of FIG. 1, but illustrating the manner in which water is delivered into the sink basin upon actuation of the faucet mechanism.

Preferably, however, when used in a lavatory environment sink assembly 12 further comprises a spray nozzle 46, which is adapted to provide a high velocity spray, and which may be located in a typical manner in the vicinity of the unitary water flow and hot/cold mix control 44, as shown in FIGS. 1 and 2. Spray nozzle 46 is typically connected to the manifold structure of faucet assembly 18 via a flexible hose (not shown), and also includes its own separate actuator and flow control (not shown). Sink assembly 12 also preferably comprises a waste water retention control 48, which is connected to stopper 38 and operates to effectuate its reciprocation between the open and closed positions, typically by way of a conventional pop-up linkage 50, a portion of which is visible in FIGS. 3 and 4, situated within waste conduit 36 in a conventional fashion. As illustrated in FIGS. 1 and 2, waste water retention control 48 also may be located in a typical manner in the vicinity of the unitary water flow and hot/cold mix control 44.

In accordance with the invention, sink bowl 14 is also provided with a plurality of perforations 52, each of which is substantially cylindrical in shape (i.e., substantially circular in cross-section) and extends entirely through the wall of basin 20, from inner surface 22 to outer surface 24. As shown best in FIGS. 1 and 3, in the preferred embodiment provided over the entirety of basin 20, distributed in an irregular pattern that generally resembles the stars in the celestial heavens, most preferably in the configuration of a specific celestial constellation, e.g., the constellation Virgo, albeit with the understanding that perforations 52 will still be distributed substantially evenly over the surface area of basin 20. In the alternative, perforations 52 may be distributed over the surface area of basin 20 in a more regular pattern, e.g., a geometric pattern extending from the center of basin 20, such as a series of bands or rings, or alternatively in a pattern resembling a star, or a letter of the alphabet, or virtually any other pattern that can be depicted with perforations. As will be apparent to those skilled in the art, the number of perforations with which the basin 20 will be provided will vary depending upon the pattern chosen. Furthermore, it will also be apparent to those skilled in the art that the number of perforations with which the alternative basin shapes mentioned hereinbefore can be provided will also vary, depending upon the shape and size chosen for the basin.

All of the perforations 52 may be of substantially the same diameter, with that diameter preferably being no less than 1/64 inches and no greater than 1/4 inches. More preferably, however, basin 20 is provided with perforations of at least two different discrete diameters, and most preferably, some of the perforations will have a first, larger diameter, while the remainder of the perforations will have a second, smaller diameter. It is to be understood that approximately equal numbers of perforations of each diameter will be provided, and that in their placement perforations of the larger diameter will preferably be intermixed in a random fashion with perforations of the smaller diameter. For most lavatory environments, an exemplary absolute dimension for the larger diameter is approximately 5/32 inches, while an exemplary absolute dimension for the smaller diameter is approximately 3/32 inches. Regardless of their diameter, however, it is to be understood that perforations 52 are preferably to be oriented in such a manner that liquid passing through them will be directed to converge towards a single location, as hereinafter described.

Perforations 52 may be created in any manner that is known in the art. For example, if basin 20-is to be manufactured by casting it in a mold, then the perforations may be formed within the mold itself, in any appropriate manner. Alternatively, if basin 20 is to be manufactured by a die-stamping process, then perforations 52 may be created during that process. Perforations 52 could also be created by drilling each one individually after basin 20 is already manufactured, although this method might be too labor-intensive to be economical. In the preferred embodiment of the present invention, with a basin hemispherically curved on a radius of 8.5 inches, the basin 20 will preferably be provided with between about one hundred and about one hundred fifty perforations 52.

Regardless of the pattern chosen for the perforations 52 or the exact number of such perforations provided, in accordance with the invention the perforations are grouped by their function into three bands or zones, i.e., an uppermost or "collar" zone 52*a* located in the collar area 54 of basin 20 and allowing for the introduction or ingress of fresh water into basin 20, an intermediate zone 52*b* located below the collar area 54 of basin 20 and providing non-stoppered or "overflow" egress of waste water, and a lowermost zone 52*c* comprising the remainder of perforations 52 and providing egress of waste water that can be stoppered when desired, as will be described in further detail hereinafter. Most preferably, the intermediate zone 52*b* of perforations 52 is more narrow than either the collar zone 52*a* or the lowermost zone 52*c*, thereby allocating more of the perforations 52 to the functions of fresh water ingress and stoppered egress of waste water than to the function of non-stoppered or "overflow" egress of waste water, although it will be apparent to those skilled in the art that the precise width of each zone of perforations 52, and hence the exact number of perforations 52 that will be encompassed within each zone, can be varied without departing from the invention.

Figure 3:
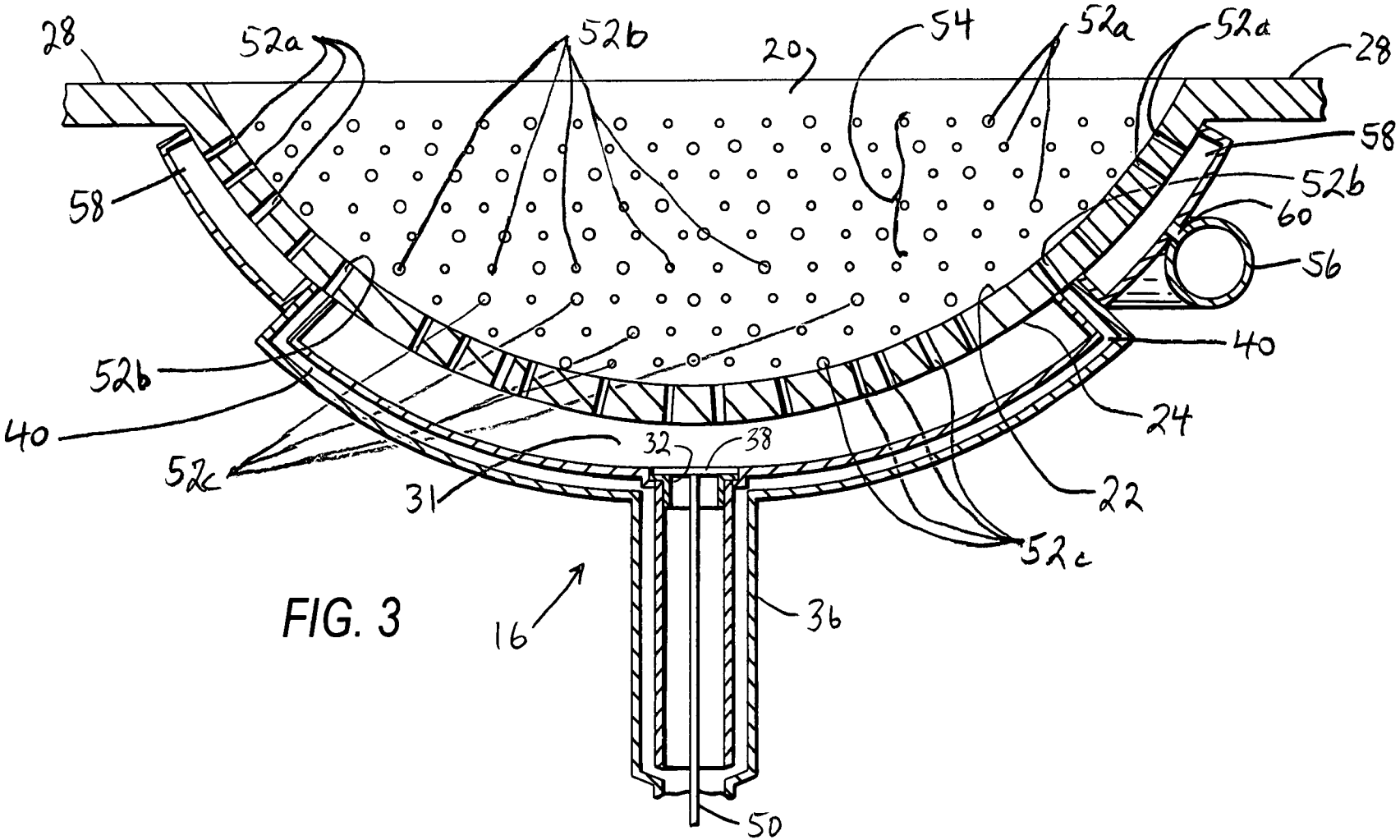
FIG. 3 is a cross-sectional view take substantially along the lines 3-3 of FIG. 1.
Figure 4:
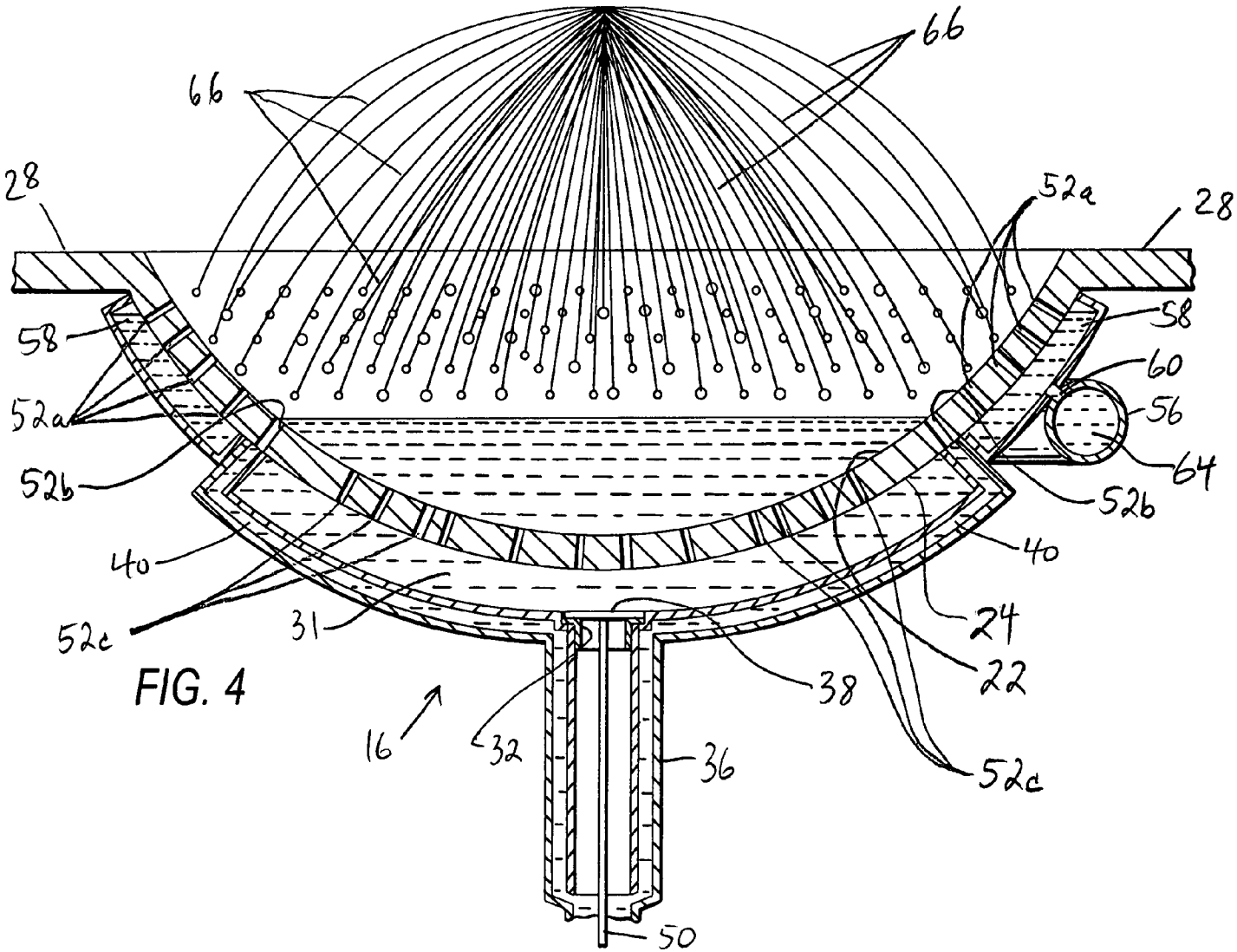
FIG. 4 is a cross-sectional view take substantially along the lines 4-4 of FIG. 2.

As to the introduction of fresh water into basin 20, in accordance with the preferred embodiment of the invention, and as shown best in FIG. 3, sink assembly 12 also includes a liquid distribution conduit 56 which is in fluid communication with the interior of basin 20 through the perforations 52 in the collar zone 52*a*. As shown in FIGS. 3 and 4, conduit 56 is preferably circular in cross-section, and communicates with the perforations 52 in the collar zone 52*a* through an annular liquid dispersion chamber. Dispersion chamber 58 may be secured to basin 20 in any conventional manner, and communicates with distribution conduit 56 though one or more apertures 60. Also in accordance with the invention, and as shown best in FIG. 3, overflow duct 40 is in fluid communication with the interior of basin 20 through the perforations 52 in the intermediate zone 52*b*, while drainage chamber 31 is in fluid communication with the interior of basin 20 through the perforations 52 in lowermost zone 52*c*.

The operation of liquid delivery system 10 will now be described. When faucet assembly 18 is actuated (i.e., when water flow control 44 is moved from the position shown in FIG. 1 towards the position shown in FIG. 2), water 64 flows into conduit 56. Thereafter, as shown best in FIG.4, the water flows from conduit 56 through one or more apertures 60 into dispersion chamber 58. After filling the void in dispersion chamber 58, the water is ejected into basin 20 through perforations 52 in the collar zone 52*a*, forming a multiplicity of independent narrow irregularly spaced streams 66 which enter basin 20 from all sides. The perforations 52 in the collar zone 52*a* form short channels which direct the water steams 66 and preferably insure that the streams are sufficiently elongated so as to converge towards and intersect with one another in the air above the sink bowl 14, thereby forming a pleasing, dome-shaped liquid display, as shown best in FIG. 2. It is to be understood, however, that a dome-shaped display, while preferable, is not essential to the invention.

As the fresh water continues to enter basin 20, it is naturally drawn towards the bottom of basin 20 by the action of gravity, and whether or not it comes into contact with an object (e.g., a human hand) as it travels downward, it is no longer considered to be fresh water once it comes into contact with the inner surface 22 of basin 20, but is considered to have been transformed into waste water, and the latter then exits from basin 20 mostly through perforations 52 in lowermost zone 52*c* and thence through drainage chamber 31, flowing freely through drain aperture 32 into waste conduit 36, although some waste water may also exit from basin 20 through perforations 52 in intermediate zone 52*b* as well, and thence through overflow conduit 40 into waste conduit 36. However, upon actuation of waste water retention control 48, causing stopper 38 to move into the closed position, i.e., to become seated within drain aperture 32 (as shown in FIG. 4), the waste water will begin to collect in drainage chamber 31, and after filling the void in drainage chamber 31, will eventually "back up" though perforations 52 in lowermost zone 52*c* and begin to fill and be retained in the bottom of basin 20, so as to provide a pool of waste water at the bottom of basin 20, which is preferred by some sink users, e.g., for rinsing and for other purposes.

Nevertheless, once basin 20 has become filled to the predetermined level, corresponding to the level at which the perforations 52 of intermediate zone 52*b* are situated, the collecting waste water begins to exit from basin 20 through perforations 52 in intermediate zone 52*b*, and thence through overflow conduit 40 into waste conduit 36. Thus, the perforations 52 in intermediate zone 52*b* not only to facilitate water drainage once basin 20 has been filled to that predetermined level, but also compel such "overflow" drainage in the event that stopper 38 remains seated within drain aperture 32 once the water retained in basin 20 has reached or has even exceeded that level (similar to the "overflow" drainage provided by the overflow aperture(s) or port(s) with which most conventional sinks are equipped). Thus, in the preferred embodiment of the invention, it will be understood that apart from the perforations 52 in intermediate zone 52*b*, basin 20 is not formed with the one or more separate, larger overflow apertures or ports which typically characterize conventional sinks, and it will also be understood that apart from the perforations 52 in lowermost zone 52*c*, basin 20 is also not formed with the unitary, stoppered, principal drain aperture or port which typically characterizes conventional sinks. However, in other embodiments of the invention it may still be necessary or desirable to supplement (or perhaps even to replace) the perforations 52 in intermediate zone 52*b* with one or more separate, larger overflow apertures or ports (not shown in the drawings) in order to insure that contamination of fresh water entering the basin is avoided.

While there has been described what are at present considered to be the preferred embodiments of the present invention, it will be apparent to those skilled in the art that the embodiments described herein are by way of illustration and not of limitation. For example, there may be other ways in which to direct the water streams 66 in order to achieve the desired effect, such as by providing individual nozzles or water jets. However, this alternative is not preferred, since it would substantially change the appearance and texture of the inner surface 22 of basin 20, and the effect of the water streams produced might not be as pleasing. Nevertheless, it is to be understood that various changes and modifications may be made in the embodiments disclosed herein without departing from the true spirit and scope of the present invention, as set forth in the appended claims.

The invention claimed is:

1. An apparatus for delivering a liquid into a sink, said apparatus comprising a sink with a drain assembly and a cavity, the cavity having an inner wall and an outer wall and having a multiplicity of perforations extending therethrough, said perforations being located in said cavity in an irregular pattern, a first plurality of said perforations being in fluid communication with a source of said liquid and said apparatus being selectively operable to introduce said liquid into said cavity therethrough in a plurality of independent irregularly spaced streams, a second plurality of said perforations being in fluid communication with said drain assembly, said drain assembly being selectively operable to allow egress of said liquid therethrough and a third plurality of said perforations in fluid communication with said drain assembly, but not subject to said selectively operable egress.

2. An apparatus according to claim 1 wherein said streams converge to form a dome-like display.

3. An apparatus in accordance with claim 2, wherein said cavity is hemispherical in shape.

4. An apparatus in accordance with claim 3, wherein said perforations are distributed over the entirety of said cavity.

5. An apparatus in accordance with claim 4, wherein said perforations are substantially circular in cross-section.

6. An apparatus in accordance with claim 5, wherein substantially all of said perforations are of substantially the same diameter.

7. An apparatus in accordance with claim 5, wherein a percentage of said perforations are of a first diameter and the remainder of said perforations are of a second diameter that is greater than said first diameter.

8. An apparatus in accordance with claim 7, wherein said percentage of said perforations comprises substantially one-half of said perforations.

9. An apparatus in accordance with claim 8, wherein said first diameter differs from said second diameter by no more than 1/32 inch.

10. An apparatus in accordance with claim 9 wherein said first plurality of said perforations is situated in the collar area of said cavity, said third plurality of said perforations is situated below said first plurality of said perforations, and said second plurality of said perforations is situated below said third plurality of said perforations.

11. An apparatus in accordance with claim 10 further comprising a distribution conduit positioned outside said cavity adjacent said outer wall and substantially surrounding said collar area, said conduit being in fluid communication with said source of said liquid, and a dispersion chamber juxtaposed between said conduit and said outer wall, said dispersion chamber being in fluid communication with said conduit and with said first plurality of said perforations.

12. An apparatus in accordance with claim 11, wherein said drain assembly comprises a waste conduit, a drainage chamber, an overflow conduit in fluid communication with said waste conduit, and a drain aperture in fluid communication with said waste conduit and in selectively closeable fluid communication with said drainage chamber, said drainage chamber also being in fluid communication with said second plurality of perforations, and said overflow conduit also being in fluid communication with said third plurality of perforations.

13. An apparatus for delivering a liquid into a sink, said apparatus comprising a sink with a cavity, the cavity having an inner wall and an outer wall and having a multiplicity of perforations extending therethrough, a drain assembly, and a faucet assembly in fluid communication with a first plurality of said perforations and with a source of said liquid, said faucet assembly being selectively operable to introduce said liquid into said cavity through said first plurality of said perforations in a plurality of independent streams, said multiplicity of perforations further comprising a second plurality of said perforations in fluid communication with said drain assembly, said drain assembly being selectively operable to allow egress of said liquid through said second plurality of said perforations and a third plurality of said perforations in fluid communication with said drain assembly, but not subject to said selectively operable egress.

14. An apparatus in accordance with claim 13, wherein said perforations are distributed in a non-regular pattern.

15. An apparatus in accordance with claim 14, wherein said cavity is hemispherical in shape.

16. An apparatus in accordance with claim 15, wherein said perforations are distributed over the entirety of said cavity.

17. An apparatus in accordance with claim 16, wherein said perforations are substantially circular in cross-section.

18. An apparatus in accordance with claim 17, wherein substantially all of said perforations are of substantially the same diameter.

19. An apparatus in accordance with claim 17, wherein a percentage of said perforations are of a first diameter and the remainder of said perforations are of a second diameter that is greater than said first diameter.

20. An apparatus in accordance with claim 19, wherein said percentage of said perforations comprises substantially one-half of said perforations.

21. An apparatus in accordance with claim 20, wherein said first diameter differs from said second diameter by no more than 1/32 inch.

22. An apparatus in accordance with claim 21 wherein said first plurality of said perforations is situated in the collar area of said cavity, said second plurality of said perforations is situated below said first plurality of said perforations, and said third plurality of said perforations is situated intermediate of said first plurality of said perforations and said second plurality of said perforations.

23. An apparatus in accordance with claim 22 further comprising a distribution conduit positioned outside said cavity adjacent said outer wall and substantially surrounding said collar area, said conduit being in fluid communication with said faucet assembly, and a dispersion chamber juxtaposed between said conduit and said outer wall, said dispersion chamber being in fluid communication with said conduit and with said first plurality of said perforations.

24. An apparatus in accordance with claim 23, wherein said drain assembly comprises a waste conduit, a drainage chamber, an overflow conduit in fluid communication with said waste conduit, and a drain aperture in fluid communication with said waste conduit and in selectively closeable fluid communication with said drainage chamber, said drainage chamber also being in fluid communication with said second plurality of perforations, and said overflow conduit also being in fluid communication with said third plurality of perforations.

25. An apparatus in accordance with claim 24, wherein said faucet assembly is located remotely from said cavity.

26. In a liquid delivery system for a sink, said system comprising a sink with a drain assembly, a cavity and a faucet assembly in fluid communication with a source of said liquid for selective introduction thereof into said cavity, the improvement comprising a multiplicity of perforations in said cavity, said perforations being located in said cavity in an irregular pattern, a first plurality of said perforations being in fluid communication with said faucet assembly, said faucet assembly being adapted to selectively introduce said liquid into said cavity through said first plurality of perforations in a plurality of independent streams, said multiplicity of perforations further comprising a second plurality of said perforations in fluid communication with said drain assembly, said drain assembly being selectively operable to allow egress of said liquid through said second plurality of said perforations, and a third plurality of said perforations also in fluid communication with said drain assembly, said drain assembly allowing egress of said liquid through said third plurality of said perforations said third plurality of said perforations not subject to said selectively operable egress.

* * * * *